US008251418B2

(12) United States Patent
Van Os et al.

(10) Patent No.: US 8,251,418 B2
(45) Date of Patent: Aug. 28, 2012

(54) GRIPPING DEVICE

(75) Inventors: Arie Johan Van Os, Alphen aan den Rijn (NL); Hendrik Cornelis Rekers, Amstelhoek (NL)

(73) Assignee: Aktiebolaget SKF, Göteborg (SE)

( * ) Notice: Subject to any disclaimer, the term of this patent is extended or adjusted under 35 U.S.C. 154(b) by 215 days.

(21) Appl. No.: 12/311,203

(22) PCT Filed: Sep. 20, 2006

(86) PCT No.: PCT/EP2006/009148

§ 371 (c)(1),
(2), (4) Date: Oct. 5, 2009

(87) PCT Pub. No.: WO2008/034455

PCT Pub. Date: Mar. 27, 2008

(65) Prior Publication Data

US 2010/0078951 A1 Apr. 1, 2010

(51) Int. Cl.
*B66C 1/00* (2006.01)

(52) U.S. Cl. ..... 294/95

(58) Field of Classification Search ..... 294/95, 294/97, 86.25, 195; 411/57.1, 60.1, 60.3; 269/66, 71, 24–27

See application file for complete search history.

(56) References Cited

U.S. PATENT DOCUMENTS

| | | | | |
|---|---|---|---|---|
| 1,403,754 | A | 1/1922 | Erickson | |
| 1,429,567 | A | 9/1922 | Carlisle | |
| 2,576,741 | A * | 11/1951 | Witek | 279/2.11 |
| 2,755,540 | A | 7/1956 | Crozier | |
| 3,990,139 | A | 11/1976 | Touchet | |
| 4,199,183 | A * | 4/1980 | Hecker | 294/97 |
| 4,291,910 | A * | 9/1981 | Maupate | 294/95 |
| 4,340,249 | A * | 7/1982 | Bucklew | 294/95 |
| 4,607,873 | A * | 8/1986 | Nusbaumer et al. | 294/202 |
| 4,694,569 | A | 9/1987 | Colvell | |
| 4,852,235 | A | 8/1989 | Trease et al. | |
| 5,358,367 | A * | 10/1994 | Yang | 411/397 |
| 6,536,088 | B1 | 3/2003 | Chiang | |
| 6,602,033 | B2 * | 8/2003 | Nettis et al. | 411/21 |

FOREIGN PATENT DOCUMENTS

| | | | |
|---|---|---|---|
| DE | 875329 | C | 4/1953 |
| FR | 663249 | A | 8/1929 |
| FR | 1390415 | A | 2/1965 |
| WO | WO95/10393 | A | 4/1995 |

* cited by examiner

*Primary Examiner* — Dean Kramer
*Assistant Examiner* — Stephen Vu
(74) *Attorney, Agent, or Firm* — Mark A. Ussai; Bryan Peckjian

(57) ABSTRACT

A gripping device comprises a cylindrical thorn, an inner body and an outer body with a plurality of movable arms, each arm comprising a claw, wherein the thorn and the inner body are directly coupled to one another, wherein a spring adapted to force the extractor device to a first position is positioned in between the inner body and the outer body. The gripping device is adapted to be set in a plurality of other positions by moving the inner body and the outer body relative to each other along the symmetry axis. The gripping device is reliable to use and is adapted to grip different sizes of inserts, such as bearings, sleeves, and etc.

11 Claims, 5 Drawing Sheets

GRIPPING DEVICE

TECHNICAL FIELD

The present invention relates to a gripping device to be used in an extractor tool for disassembling parts. This gripping device is especially advantageous for the removal of roller bearings, but is also well adapted for the removal of sleeves, bushings, etc. mounted in a housing. For bearings, the gripping device is adapted to grip the inner ring of a complete bearing mounted in a housing, or to grip the inner side of an outer bearing ring, e.g. of a broken bearing.

BACKGROUND ART

In mechanical designs, there is a need to fasten parts to one another. Some parts, such as bearings, sleeves, bushings and the like are often attached to one another by press fit. Since the purpose of using press fit is to fix the parts together in a firm way, the removal of such a part may prove to be cumbersome.

U.S. Pat. No. 6,536,088 B1 describes a gear puller with outwardly forced jaws. The jaws are inserted into the inner hole of e.g. a bearing. An actuator rod is inserted between the jaws and held in place with a quick coupler. A slide hammer is attached to the jaws with another quick coupler.

U.S. Pat. Nos. 1,429,567, 2,755,540, 3,990,139 and 4,694,569 describes different pulling devices wherein jaws are brought into the gripping position by a screwing action. The part to remove is then removed by another screw action.

U.S. Pat. No. 4,852,235 describe a pulling device where the jaws are pushed apart and held in place by manually pushing a sleeve into the gripping position.

DISCLOSURE OF INVENTION

An object of the invention is therefore to provide an improved gripping device that is easier and more efficient to use. Another object of the invention is to provide an improved gripping device that is adapted for different sizes of inner rings. A further object of the invention is to provide an improved gripping device that adapts itself automatically to different sizes of inner rings. A further object of the invention is also to provide a gripping device with an improved design containing fewer parts.

The solution to this problem according to the invention and advantageous embodiments and further developments of the gripping device of the invention are disclosed herewith.

With an gripping device, comprising a cylindrical thorn, an inner body and an outer body with a plurality of movable arms, each arm comprising a claw, wherein the thorn and the inner body are directly coupled to one another and wherein the thorn extends through the outer body, the object of the invention is achieved in that the device also comprises a spring positioned in between the inner body and the outer body which spring is adapted to force the gripping device to a first gripping position and in that the gripping device is adapted to be set in a plurality of other gripping positions by moving the inner body and the outer body relative to each other along the symmetry axis.

By this first embodiment of the gripping device according to the invention, a gripping device is obtained which is semi-automatic and which can be used for parts with different inner diameters. The parts to be removed are preferably bearings but other parts are also conceivable. This is achieved by using a spring loaded action in the gripping device pushing the arms of the gripping device towards a first gripping position. This action thus adapts for any size of part to be removed that is in the predefined range for a specific gripping device. This allows for a gripping device that is easy and efficient to use.

In an advantageous further development of the gripping device according to the invention, the thorn and the inner body are made from two pieces. This allows for an easy assembly of the gripping device.

In an advantageous further development of the gripping device according to the invention, the front section of the gripping device comprises slots to accommodate the arms. This improves the stability of the gripping device even further.

In an advantageous further development of the gripping device according to the invention, the arms of the gripping device are held together by a second spring means. This improves the function of the gripping device even further.

In an advantageous further development of the gripping device according to the invention, the gripping device comprises receiving means adapted for the connection to a force generator. This improves the performance of the gripping device even further.

In an advantageous further development of the gripping device according to the invention, the gripping device comprises markings to indicate the different predefined gripping positions that correspond to predefined bearings. This improves the reliability of the gripping device and ensures that the device is used in a proper way.

BRIEF DESCRIPTION OF DRAWINGS

The invention will be described in greater detail in the following, with reference to the embodiments that are shown in the attached drawings, in which.

DETAILED DESCRIPTION

The embodiments of the invention with further developments described in the following are to be regarded only as examples and are in no way to limit the scope of the protection provided by the patent claims.

In the following, a radial bearing is used as an example of a part that is to be removed with the inventive gripping device.

The radial bearing consists of an outer ring, a plurality of rolling elements, such as balls, cylindrical rollers, needle rollers, tapered rollers or spherical rollers, and an inner ring. The gripping device is adapted to extract the complete bearing by the inner ring. The gripping device is also suitable to extract other similar parts, such as different types of bearings, sleeves, bushings, inner rings and other types of parts where it is possible to apply the gripping device through the centre hole of the part in question. Further, the gripping device is also adapted to grip the inner part of an outer ring of e.g. a broken bearing or a splitable bearing, i.e. a bearing where the inner ring and the rolling elements are missing, that is mounted in a housing.

Figure 3:
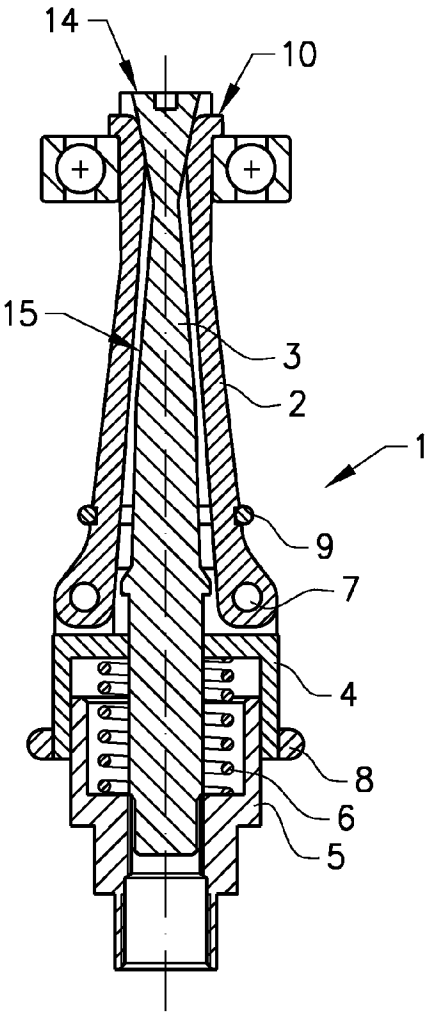
FIG. 3 shows a cross-section of the gripping device according to the invention with the arms in a second gripping position.
Figure 2:
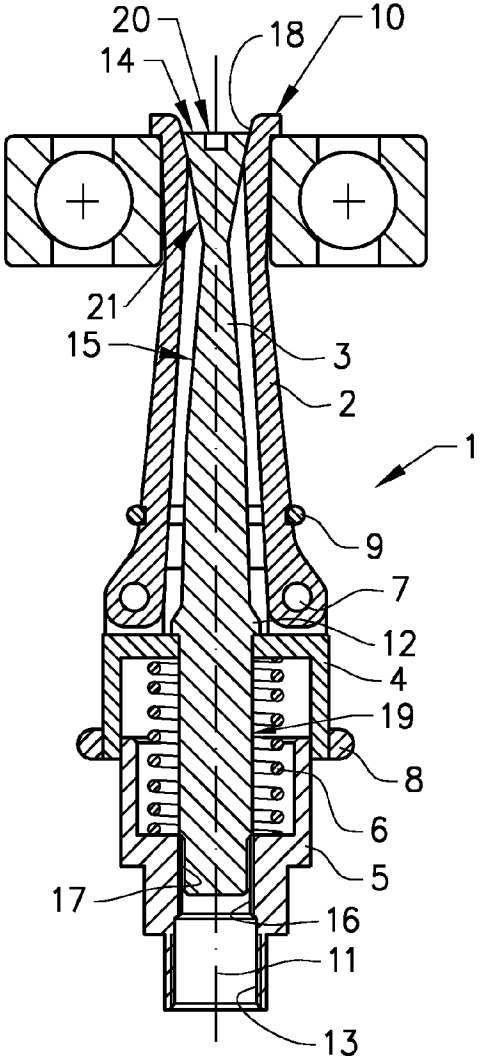
FIG. 2 shows a cross-section of the gripping device according to the invention with the arms in a first gripping position.
Figure 1:
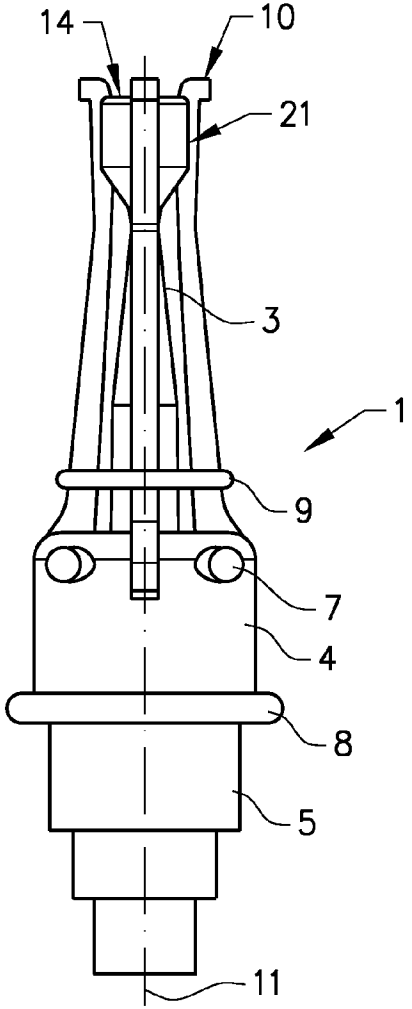
FIG. 1 shows a full side view of the gripping device according to the invention.

FIGS. 1, 2 and 3 shows a first embodiment of the inventive gripping device. The gripping device 1 comprises a cylindrical central thorn 3, an inner body 5, an outer body 4 and a plurality of movable arms 2. The central thorn 3, the inner body 5 and the outer body 4 are of a cylindrical shape with a central symmetry axis 11. The thorn 3, the inner body 5, the outer body 4 and the arms 2 are preferably manufactured of steel or an alloy. The parts may be completely or partly hardened, depending on the parts to be removed. The manufacturing process can be any suitable process well known to the skilled person.

The thorn 3 is circular and extends along a central symmetry axis 11. The thorn 3 is provided with a front section 14, a middle section 15 and a rear section 19. The front section 14 is circular and consists in this example of a straight first part and a tapered second part, although other shapes are conceivable. The front section 14 is further provided with slots 21 for the arms 2. The slots 21 are tapered inwardly from the top of the front section. The purpose of the slots is to support the arms sideways. The purpose of the tapering is to allow for the arms, when they slide backwards towards the rear section of the thorn, to move in a direction towards the centre of the thorn, thereby reducing the total outer diameter of the gripping device. This allows the gripping device to be inserted into e.g. an inner ring of a bearing. In one embodiment, the front section is provided with only a tapering, on which the arms rest, i.e. there are no slots. This may be the case when the dimensions used do not allow for slots, or in order to simplify the production of the gripping device. In this case, the middle section may be provided with slots, in order to provide sideways support for the arms.

Figure 5:
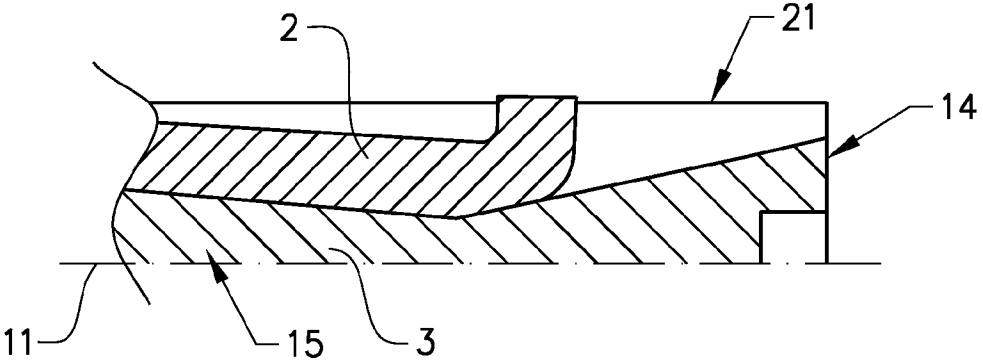
FIG. 5 shows a split cross-section of a further embodiment of the gripping device according to the invention with the arms in a closed position.
Figure 6:
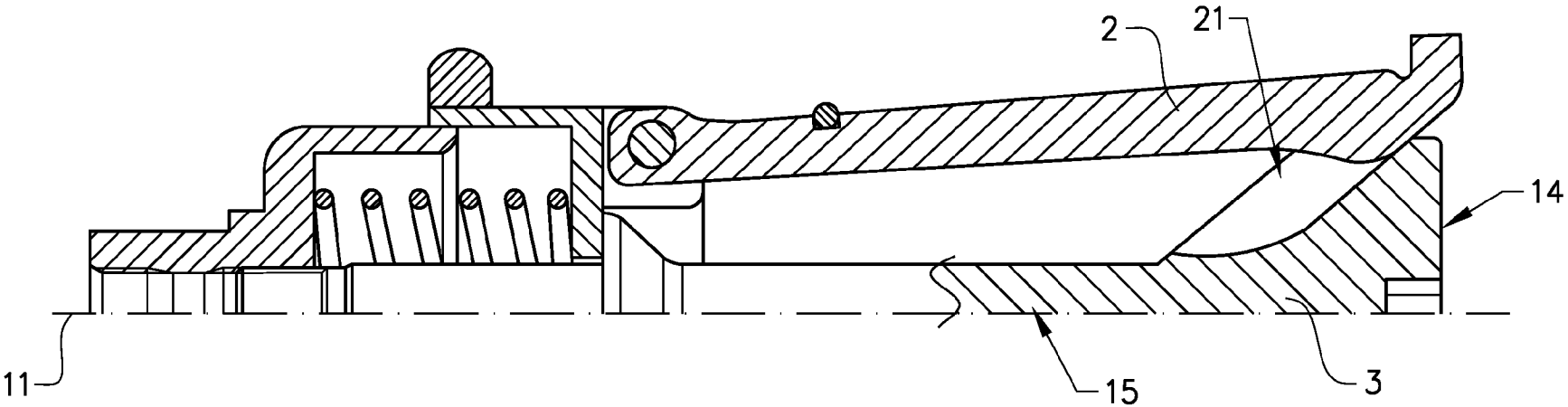
FIG. 6 shows a split cross-section of a further embodiment of the gripping device according to the invention with the arms in a first gripping position.

In FIG. 5, an embodiment of the thorn 3 is shown, in which the front section 14 and the middle section 15 have the same outer diameter and where the slots 21 are provided in both the front section 14 and the middle section 15. The slots 21 are tapered as described above. This may be advantageous for smaller dimensions in order to obtain as much material as possible in the thorn. In FIG. 6, another embodiment of the thorn 3 is shown, in which only the front section 14 is provided with slots 21 and where the middle section 15 is straight, without slots. This may be advantageous for larger dimensions in order to reduce weight.

The middle section 15 consists in this example of a tapered first part and a straight second part, although other shapes are conceivable. The middle section may be provided with slots or flat surfaces for the arms to slide on. When the front section of the thorn supports the arms sideways, it may be advantageous to provide the middle section with only flat surfaces in order to reduce friction between the arms and the thorn. The middle section may of course also, partly or completely, be provided with slots supporting the arms sideways, if desired.

The inner body 5 is directly coupled to the thorn 3, so that they form a single part in which the inner body 5 and the thorn 3 do not move in relation to one another. The rear part of the thorn is for that purpose provided with an outer thread 17 that is mounted to an inner thread 16 of the inner body. In order to facilitate the mounting of the thorn to the inner body, the front section of the thorn may be provided with a key grip, e.g. a hexagonal recessed hole 20. The inner body may be provided with an outer grip, e.g. two, four or six flat surfaces for an adjustable wrench or a jaw spanner. The inner body and the thorn may also be assembled in other ways, e.g. by gluing or cramping.

Figure 8:
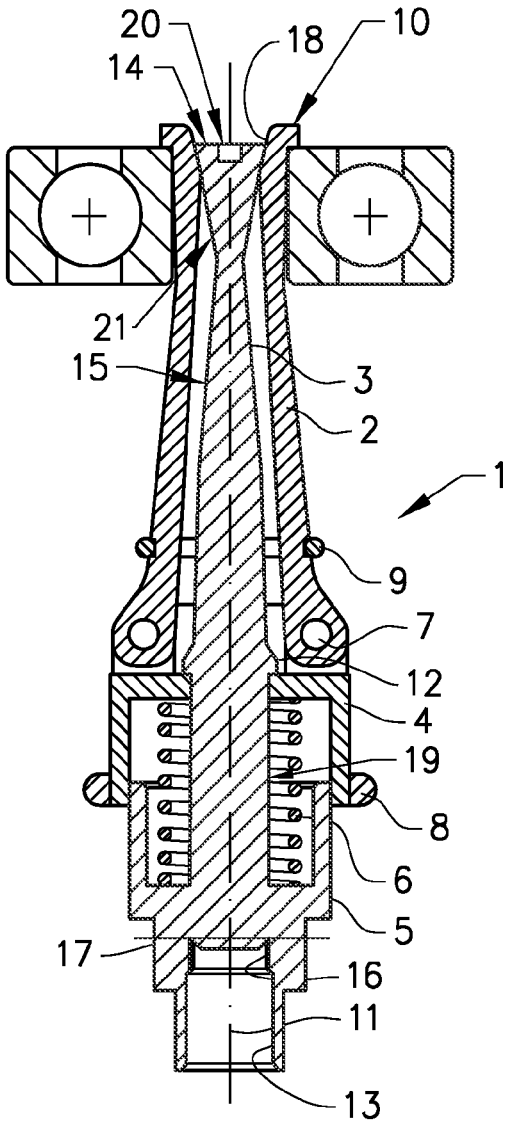
FIG. 8 shows a split cross-section of a further embodiment of the gripping device according to the invention comprising a unitary thorn and inner body.

In one embodiment, the inner body and the thorn may also be formed from one single piece as illustrated in FIG. 8. In such a case, the stop 12 on which the outer body rests when the gripping device is in a first position may be assembled after the assembly of the outer body. The stop may also constitute grooves in the middle part 15 of the thorn together with protrusions on the rear parts of the arms.

When the inner body and the thorn are assembled, the thorn extends through the outer body 4. The outer body rests on a stop 12 provided on the rear section of the thorn. A spiral spring 6 is provided between the inner and the outer bodies in order to force the bodies apart. The inner body extends somewhat into the outer body in order to stabilise the outer body sideways. The inner and the outer bodies both have internal cavities to provide space for the spiral spring 6.

The outer body 4 is provided with channels that accommodate the rear part of the arms 2. Each channel is suitably provided with a hole in which a suitably hinge pin 7 is inserted, locking each arm to the outer body in a movable way. In this example, the gripping device is provided with four arms. Depending on e.g. the size of the inner ring to remove, the material used in the gripping device and the force required to remove the inner ring, other numbers of arms are also conceivable. An extractor device with two or three arms may e.g. be advantageous for smaller inner rings, and for the removal of larger parts, a number of up to and over ten arms is conceivable in order to increase the contact surface between the arms and the part to be removed, if desired. The outer body may also be provided with a grip ring 8 to facilitate the setting of the gripping device to a gripping position.

In one example embodiment, four arms are suitable for the removal of inner rings with a diameter of above e.g. 15 mm. For the removal of inner rings with a diameter below 15 mm, an embodiment with for example three arms may be used. For the removal of inner rings with a diameter in the order of around 50 mm and more, an embodiment with for example eight arms may be used.

The arms 2 are each provided with a claw 10 in the front part of the arm. The claws extend outwardly from the centre of the gripping device and are adapted to grip the part to be removed. In FIGS. 2 and 3, an example of the claws gripping the edge of an inner ring of a ball bearing can be seen. It is important that the claws are deep enough to grip the part to be removed in a secure way, e.g. with respect to a radius on the edge of that part. The front part of each arm is also provided with a tapered inner surface 18 that is adapted to slide in the slots 21 of the front section of the thorn. The arms are also provided with recesses where an arm spring 9 is mounted. The purpose of the arm spring 9 is to pull the arms towards the thorn, keeping the inner surfaces 18 of the arms in constant contact with the slots 21 of the thorn.

Figure 4A:
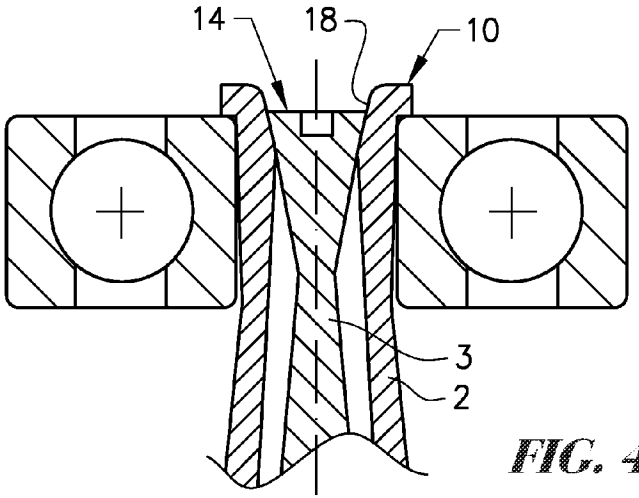
FIG. 4*a* shows a detailed cross-section of the front section of the of the embodiment in FIG. 2.

The spring 6 will exert a force between the inner body and the outer body, forcing the bodies apart. This in turn will push the arms forwards towards a first gripping position, in which the outer body rests on the stop 12. In this first gripping position, the arms extend as far outwardly as possible. In FIG. 4*a*, an example where the arms are in the first gripping position is shown. The first gripping position is adapted for use with inner rings that has the greatest inner diameter for the specific gripping device.

Figure 4B:
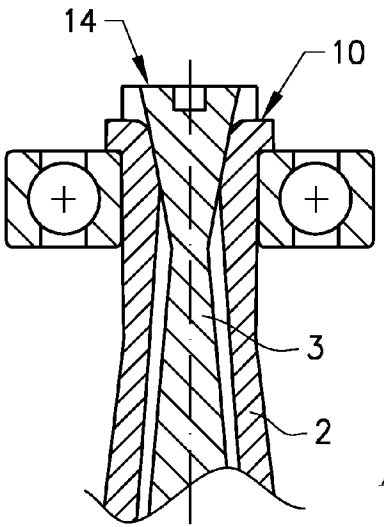
FIG. 4*b* shows a detailed cross-section of the front section of the of the embodiment in FIG. 3.

By moving the outer body towards the inner body, the arms will leave the first gripping position and move to a second gripping position. FIG. 4*b* shows an example where the arms are in a second gripping position. In this second gripping position, the arms are adapted for use with an inner ring that has a reduced diameter compared with the first gripping position. By pulling the outer body further, a third gripping position is reached (not shown). The design of the gripping device determines the number of possible different gripping positions. In one example, the extractor device is adapted for the removal of bearings with an inner ring diameter of 17 mm, 16 mm and 15 mm. Other ranges and sizes are conceivable. By using a plurality of different gripping devices, the complete need of a workshop can be provided for.

Figure 4C:
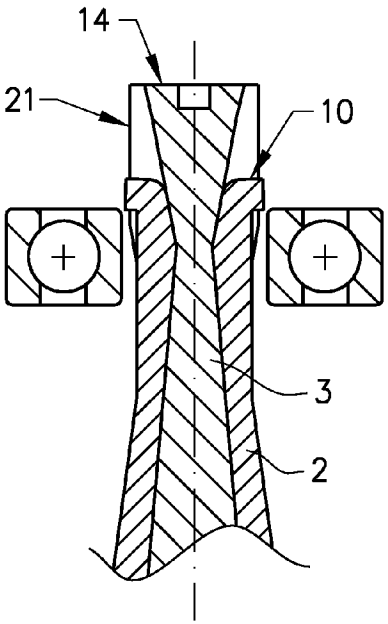
FIG. 4*c* shows a detailed cross-section of the front section in a closed position of the gripping device according to the invention.

When the outer body is pulled completely towards the inner body, e.g. when the outer body bears on the inner body, the arms are in an end position or a closed position. In this end position, the claws are enclosed by the slots in the front section of the thorn, thus enabling the gripping device to be inserted into the inner ring, i.e. the claws are inserted through the inner ring. This end position is shown in FIG. 4*c*.

When the gripping device has been inserted into the inner ring of a ball bearing, the outer body is let loose so that the spring 6 can force the outer and inner bodies apart, thus allowing the arms to move towards the first gripping position. When the arms reach a predefined position, i.e. the position that corresponds to the inner ring diameter of the part to be removed, the arms will rest on the inner side of the inner ring and the claws will rest on the edge of the inner ring. This position allows for the removal of the inner ring.

In this removal position, the arms will rest on the inner side of the inner ring. At the same time, the inner surfaces 18 of the arms will rest on the inner surface of the slots 21. The arms are thus pressed between the inner ring and the thorn 3. By applying a force on the thorn in a direction towards the rear of the gripping device, the pressure on the arms towards the inner ring will increase further. This is due to the fact that the front part of the thorn is tapered. In this way, the claws are prevented from slipping off the edge of the inner ring. Thus, a secure grip of the gripping device is provided for without the user having to adjust or preset the gripping device, e.g. by screw adjustment. Further, tolerances of the device and the flexibility of the material are compensated for.

Figure 7:
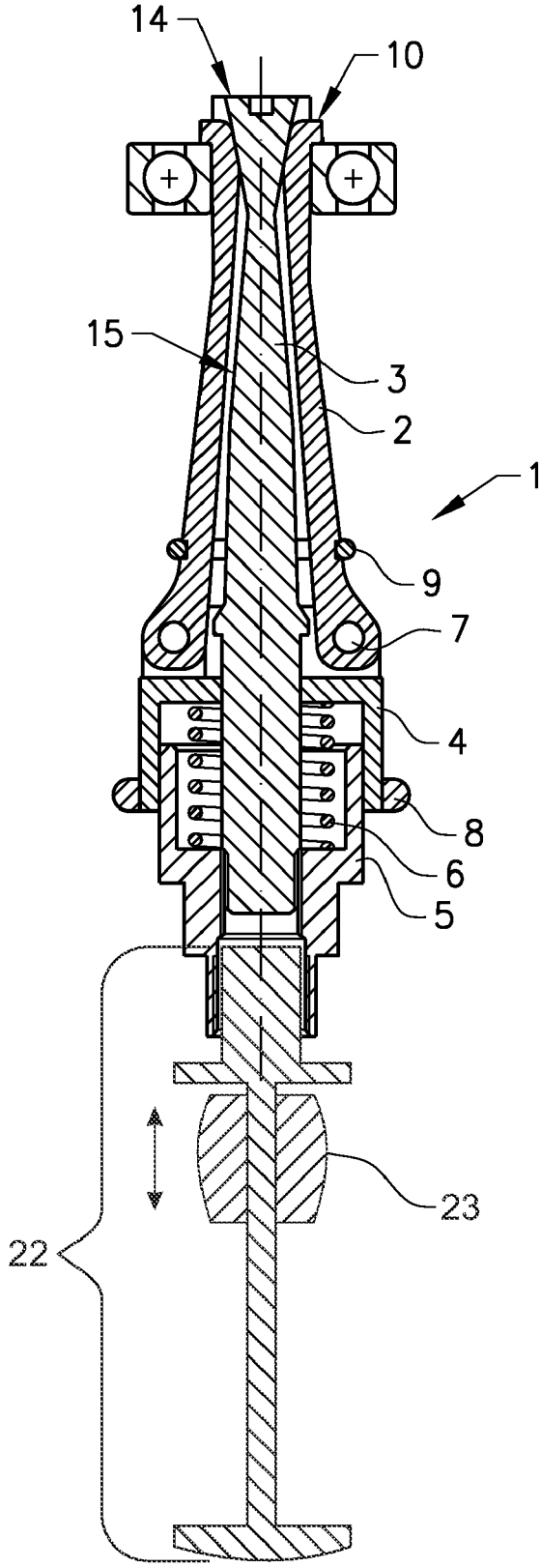
FIG. 7 shows a split cross-section of the gripping device introduced in FIG. 3, the illustration introducing a force generator provided in an exemplary form of a slide hammer.

To facilitate the removal of the inner ring, the gripping device may be connected to a force generator 22 (FIG. 7), creating a complete extractor tool. The force generator 22 may be e.g. a hammer or a spindle with bridge. This is done by using a receiving means 13 in the inner body. In this example, an inner thread 13 is adapted to be mounted to a slide hammer 23, known to the skilled person. By striking the slide hammer 23, the gripping device will pull the inner ring out via the claws. Since the slots 21 in the front section of the thorn are tapered inwardly, and the inner surfaces 18 of the arms are tapered as well, the thorn will exert a force outwardly on the arms when the slide hammer in stricken. This outwardly force will thus prevent the arms from moving inwards, preventing them from slipping on the edge on the inner ring. This allows for a secure hold of the gripping device to the inner ring, a hold that is increased further when the gripping device is used.

Other force generators may be used as well, e.g. hydraulic or air powered tools. The advantage with a slide hammer is that it does not need to bear on a surface on the structure in which the part to remove is positioned. When a large amount of parts are to be removed, an automatic extractor tool may be advantageous. The removal of a bearing may be done either with a number of extraction blows, e.g. supplied with a slide hammer, or with a continuous movement, e.g. supplied by a hydraulic tool.

When the bearing is removed, the outer body need only be moved towards the inner body, i.e. the arms are moved to their closed position, in order to release the bearing.

In a further embodiment, the inner body of the gripping device may be provided with markings (not shown) to indicate the different predefined gripping positions that correspond to predefined bearings. The markings may e.g. be different rings painted on or embedded into the inner body. If e.g. a bearing with an inner ring diameter of 16 mm is to be removed, the marking corresponding to 16 mm must be visible when the gripping device is inserted into the inner ring. If the marking is not visible, there is an indication of a fault. This may either be that the gripping device is not inserted properly, or that the inner ring is of the wrong size. In both cases, the operator can control the inner ring and/or the insertion before continuing with the removal.

The invention is not to be regarded as being limited to the embodiments described above, a number of additional variants and modifications being possible within the scope of the subsequent patent claims. The gripping device can, for example, also be adapted for the removal of parts with other outlines than circular, e.g. elliptic or regular shaped outlines such as rectangles, hexagonal shapes, etc.

1: Gripping device
2: Arm
3: Central thorn
4: Outer body
5: Inner body
6: Spring
7: Hinge pin
8: Grip ring
9: Arm spring
10: Claw
11: Symmetry axis
12: Stop
13: Threaded connector
14: Front section of thorn
15: Middle section of thorn
16: Inner thread in outer body
17: Outer thread on thorn
18: Inner surface on arm
19: Rear section of thorn
20: Hexagon hole for hexagon wrench
21: Slots in front section
22: Force generator
23: Slide hammer

The invention claimed is:

1. A gripping device comprising:

a cylindrical thorn presenting a tapered part, an inner body, an outer body with a plurality of movable arms, each of said arms including a claw, the thorn and the inner body being directly coupled to one another with the thorn extending through the outer body, a spring positioned in between the inner body and the outer body and adapted to push the arms to a first gripping position, an arm spring placed around said plurality of arms in order to pull the arms towards the thorn, and wherein the gripping device is adapted to set the arms in a plurality of other gripping positions by moving the inner body and the outer body relative to each other along a symmetry axis through the inner body and the outer body with the tapered part of the cylindrical thorn allowing the movable arms to slide about the cylindrical thorn to move in a direction towards the symmetry axis thereby reducing an outer diameter of the gripping device.

2. The gripping device according to claim 1, wherein the thorn and the inner body are formed as one-piece.

3. The gripping device according to claim 1, wherein the thorn and the inner body are formed from at least two pieces fixedly assembled together.

4. The gripping device according to claim 1, wherein a front section of the thorn is tapered inwardly.

5. The gripping device according to claim 4, wherein the front section of the thorn is provided with a hole.

6. The gripping device according to claim 1, wherein a front section of the thorn is provided with a plurality of slots adapted to receive said plurality of arms.

7. The gripping device according to claim 6, wherein the slots are tapered inwardly.

8. The gripping device according to claim 1, wherein a middle section of the thorn is provided with at least one of a plurality of slots and flat surfaces adapted to receive said plurality of arms.

9. The gripping device according to claim 1, further comprising a receiving means adapted for connection to a force generator.

10. An extractor tool comprising:

a cylindrical thorn presenting a tapered part, an inner body, an outer body with a plurality of movable arms, each of said arms including a claw, the thorn and the inner body being directly coupled to one another with the thorn extending through the outer body, a spring positioned in between the inner body and the outer body and adapted to push the arms to a first gripping position, an arm spring placed around said plurality of arms in order to pull the arms towards the thorn, and a receiving means adapted for connection to a force generator, wherein the extractor tool is adapted to set the arms in a plurality of other gripping positions by moving the inner body and the outer body relative to each other along a symmetry axis through the inner body and the outer body with the tapered part of the cylindrical thorn allowing the movable arms to slide about the cylindrical thorn to move in a direction towards the symmetry axis thereby reducing an outer diameter of the gripping device.

11. The extractor tool according to claim 10, wherein the force generator is a slide hammer.

* * * * *